US005768756A

United States Patent [19]

Noelle

[11] Patent Number: 5,768,756

[45] Date of Patent: Jun. 23, 1998

[54] PROCESS AND DEVICE FOR MANUFACTURING A NON-WOVEN UNPATTERNED TEXTILE

[75] Inventor: Frédéric Noelle, Grenoble, France

[73] Assignee: ICBT Perfojet, France

[21] Appl. No.: 765,319

[22] PCT Filed: Apr. 30, 1996

[86] PCT No.: PCT/FR96/00654

§ 371 Date: Dec. 24, 1996

§ 102(e) Date: Dec. 24, 1996

[87] PCT Pub. No.: WO96/36756

PCT Pub. Date: Nov. 21, 1996

[30] Foreign Application Priority Data

May 17, 1995 [FR] France ..... 9506079

[51] Int. Cl.[6] ..... D04H 13/00

[52] U.S. Cl. ..... 28/104; 28/105

[58] Field of Search ..... 28/104, 105, 163, 28/167; 162/115, 318

[56] References Cited

U.S. PATENT DOCUMENTS 3,214,819 11/1965 Guerin .
3,485,706 12/1969 Evans ..... 28/105
3,508,308 4/1970 Bunting, Jr. et al. .
3,750,237 8/1973 Kalwaites ..... 28/105
3,800,364 4/1974 Kalwaites ..... 28/105
4,691,417 9/1987 Vuillaume ..... 28/105
5,414,914 5/1995 Suzuki et al. ..... 28/105

FOREIGN PATENT DOCUMENTS 2488920 3/1985 France .
92/07984 5/1992 WIPO .

*Primary Examiner*—Amy B. Vanatta
*Attorney, Agent, or Firm*—Wall Marjama & Bilinski

[57] ABSTRACT

A process for the manufacture of non-woven unpatterned cloth in which a fibrous base cloth made from elementary fibers is conveyed onto a rotating perforated drum having a plurality of micro-holes. The micro holes are distributed in a randomized manner over the drum surface allowing a plurality of pressurized water jets to effectively act upon the base cloth taken up by the drum with increased pressure and without the effects of shadow marking on the processed cloth.

12 Claims, 3 Drawing Sheets

PROCESS AND DEVICE FOR MANUFACTURING A NON-WOVEN UNPATTERNED TEXTILE

BACKGROUND OF THE INVENTION

The present invention relates to a perfected process for the manufacture of a light, unpatterned, non-woven textile cloth by the technique using pressured water jets. The invention also relates to a device for the implementation of said process.

U.S. Pat. Nos. 3,214,819, 3,508,308 and 4,190,695 describe a process for the manufacture of non-woven textile cloth in which the adhesion and interweaving of the elementary fibers are not achieved mechanically, but rather by use of a large number of jets of water under high pressure crossing a veil or cloth placed over a perforated support.

In a needle-like manner, the water jets, with a usual pressure of at least 30 bars, and sometimes 100 bars or more, cause the interweaving of the elementary fibers, resulting in the cohesion of the obtained non-woven cloth. These non-woven cloths are known in the literature by the American term "spunlace cloth" or "spunlace". It is not, therefore, necessary to describe here in detail this technique for hydraulic interweaving.

In broad terms, the technique consists of first producing a base cloth formed of elementary fibers. The fibers of this cloth are then intermingled in movement over a continuous perforated sheet by means of a row of adjacent high-pressure water jets (50 to 200 bars). The water from the jets crosses the cloth and is repelled back onto the sheet. In this manner, the combination of direct and deflected jets creates turbulence which disturbs and then arranges the elementary fibers. In order to achieve efficient interweaving, the continuous sheet is usually made from metal or polyester, with porosity of between 15 and 25 percent.

In FR-A-2 488 920, it was suggested that the continuous perforated sheet base for the elementary cloth be replaced by a number of smooth, water-impermeable, rotating cylinders, for example, of stainless steel. However, this solution is inconvenient in that it limits the speed of the water jets and hence the interweaving energy, since it becomes difficult to properly remove the water ejected from the jets. Moreover, this technique results in the appearance of numerous defects on the surface of the cloth produced.

In U.S. Pat. No. 3,485,706, it was proposed that the sheet be replaced by a rotating drum perforated with a large number of holes approximately one millimeter in size, organized in an appropriate pattern, parallel or staggered. Such a replacement enables the production of cloths with a center pattern corresponding to that on the drum. However, the fact that these holes are arranged in an ordered manner results in the well-known problem referred to shadow marking," i.e., the appearance of preferential lines on the finished cloth. In order to limit shadow marking problems, it is necessary to reduce the jet pressure, thus considerably impairing the efficiency of the process and lowering the mechanical performance of the product. Equally, if pressure is maintained, the cloth rapidly declines in quality.

SUMMARY OF THE INVENTION

The present invention solves the above-mentioned inconveniences. It is a broad object of the present invention to overcome the above disadvantages and to provide an improved process for manufacturing a non-woven, unpatterned cloth textile using pressured water jets, and also to provide a device for carrying out this process.

The invention therefore provides a process for the manufacture of non-woven unpatterned cloth using pressured water jets, comprising passing a base cloth made from elementary fibers over a perforated rotating drum, a partial vaccum being applied within said drum and the surface of said drum being provided with a large number of micro-holes; and directing a row of said pressured water jets at said rotating drum bearing said cloth, the micro-holes of said drum being distributed in a random manner.

In other words, the invention comprises the employment of a rotating drum supporting the cloth and provided with a large number of micro-holes distributed in a random, rather than an ordered, manner. The term "in a random manner" should be understood to mean the placement of micro-holes on the entire surface of the drum in a chance manner, namely, the micro-holes on the surface of the drum are not ordered in any particular manner, in any direction. However, for reasons of efficient hydraulic functioning and the mechanical rigidity of the drum, the spaces between the edges of neighboring holes should be at least 0.3 mm, and, in practice, at most 2 mm.

Although the dimensions of the holes are identical in the first embodiment, it is also possible to use holes, the dimensions of which vary in a random manner within the rang defined below. Similarly, while the holes are usually cylindrical in form, it is also possible to use holes of a truncated or parabolic form, or even of a trumpet-shaped form.

It could not have been predicted that the simple step of arranging the microholes of the rotating drum in a random manner would enable, on the one hand, and as seen in the comparative examples below, a substantial improvement, in the order of 30% and more, in the mechanical properties of the cloths produced, and, on the other hand, an increase in the water jet pressure, also in the order of 30% and more. When the rotating drum bears micro-holes ordered in a regulated manner, such an increased pressure is impossible, since it would inevitably cause the destruction of the cloth.

The fact that the micro-holes are arranged in a random manner optimizes the deflection of the water jets in all directions, preventing the appearance of shadow marking. Moreover the efficiency of the flow, and hence of the interweaving of the fibers, can be improved by permitting the use of increased pressure and thus greater speeds of water impact on the cloth. It is preferred that the micro-holes have a diameter of between 0.1–0.5 mm.

In practice, the vacuum inside the drum is of a water column of 100–1000 mm, and preferably approximately 500 mm; the diameter of the rotating drum is between 300–1000 mm, and preferably around 500 mm.

For best results, the porosity, i.e., the relationship between perforated and non-perforated surfaces, of the typical rotating drum is between 1–15%, and preferably about 3–12%, in order to permit good water drainage while remaining compatible with the desired hydraulic flow.

In a preferred manner of implementation, the base cloth is first compressed and then pre-dampened on a continuous perforated sheet before being interwoven by the high-pressure water jets, as described in French Patent Application No. 95.01473, filed by the present Applicant on Feb. 3, 1995.

The invention also provides a device for the manufacture of non-woven, unpatterned textile cloth using pressure water jets, including a porous, continuous conveyor belt adapted to receive a fibrous base cloth produced from elementary fibers; movement means for driving said porous belt; a rotating, cylindrical, perforated drum, the surface of said drum being provided with a large number of micro-holes; movement means synchronized with the speed of movement of said porous conveyor belt, said belt being arranged tangentially to said rotating drum; a hollow, cylindrical drum affixed inside said rotating drum and linked to a vacuum source; said hollow drum being provided with a first slot configured to be placed adjacent to the meeting point of said rotating drum and said porous conveyor belt; a first row of water jets placed on the other side of the porous conveyor belt relative to said rotating drum, and in alignment with said first slot in such a manner as to form a moisturizing water curtain; at least one second row of water jets placed adjacent to said rotating drum opposite at least one second slot located in said hollow drum; and means for receiving the moist, compressed cloth thus produced; the micro-holes of said rotating drum being distributed on the surface of the drum in a random manner.

In practice, the random perforations in the rotating drum are achieved by the technique of serigraphy, in which nickel, or another metal, is electrolytically deposited on a conductive surface, as follows: Appropriate software is used to obtain the random distribution of the micro-holes on a photographic film. The film is then placed on a matrix conforming precisely to the interior diameter of the drum to be produced. This matrix is first coated with a photosensitive layer, and after this has been isolated, the matrix is immersed in an electrolytic bath. After approximately eight hours, the deposit reaches its optimal thickness. The cylinder is then removed from the mold.

In a modification of the above-described process, the software is linked directly to an engraving laser.

The manner in which the invention may be utilized and its ensuing advantages are more clearly seen from the following examples of implementation, together with the attached drawings.

DETAILED DESCRIPTION OF THE INVENTION

Figure 1:
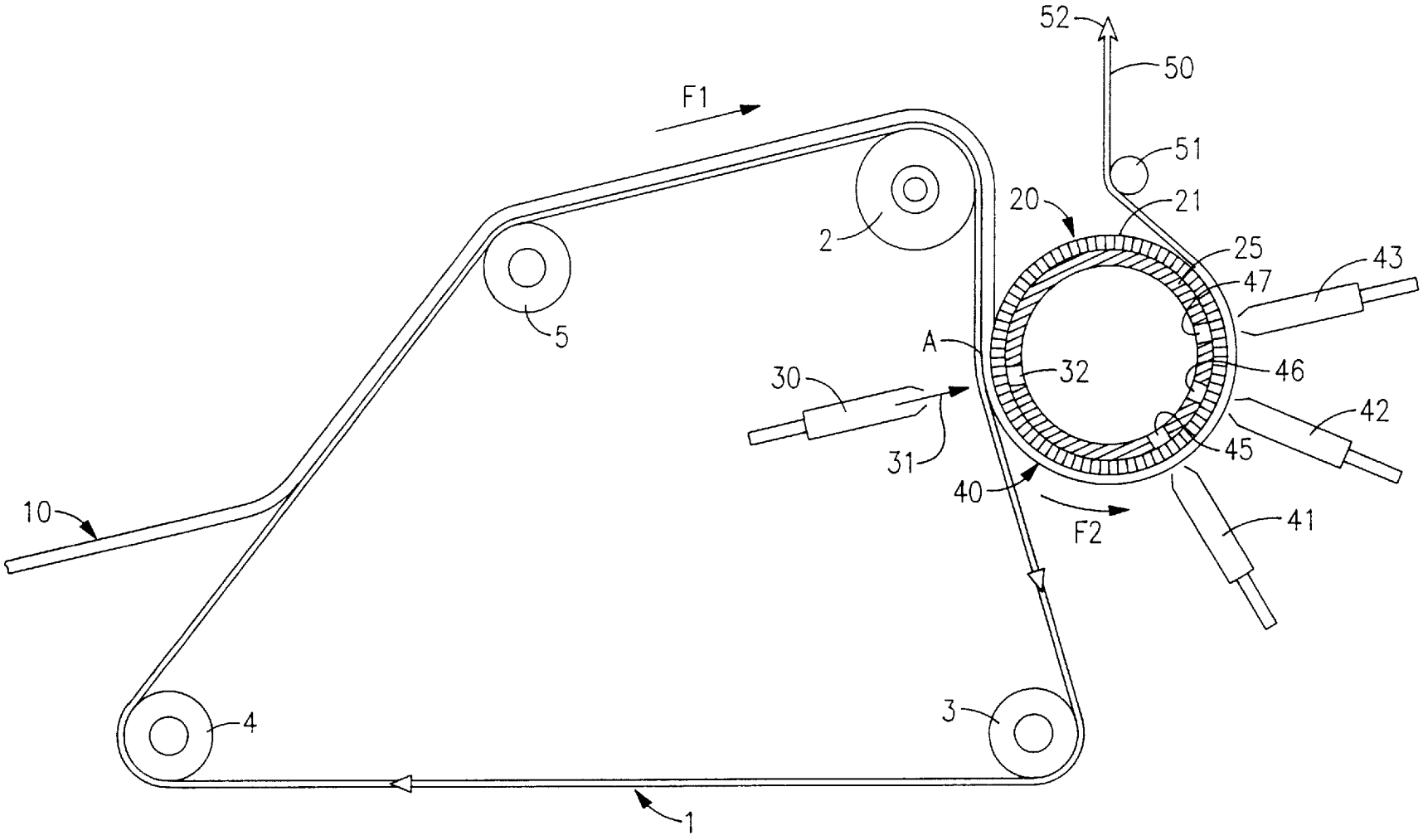
FIG. 1 is a schematic representation of a device in accordance with the invention.

The device according to the present invention includes a continuous, porous conveyor belt 1, formed of a polyester monofilament sheet with a porosity of approximately 50% i.e., in which the ratio of perforated and non-perforated surfaces is approximately 1:1. Continuous conveyor 1 is fed by a feeder roller 2, powered, for example, by an asynchro motor, and passes over guiding rollers 3, 4, and 5. Conventionally, the tensing of the belt 1 is achieved by a tension jack (not shown).

A base cloth 10, produced of conventional card or cloth material (not shown) is placed on conveyor belt 1. The cloth moves in the direction shown by the arrow F1.

Figure 2:
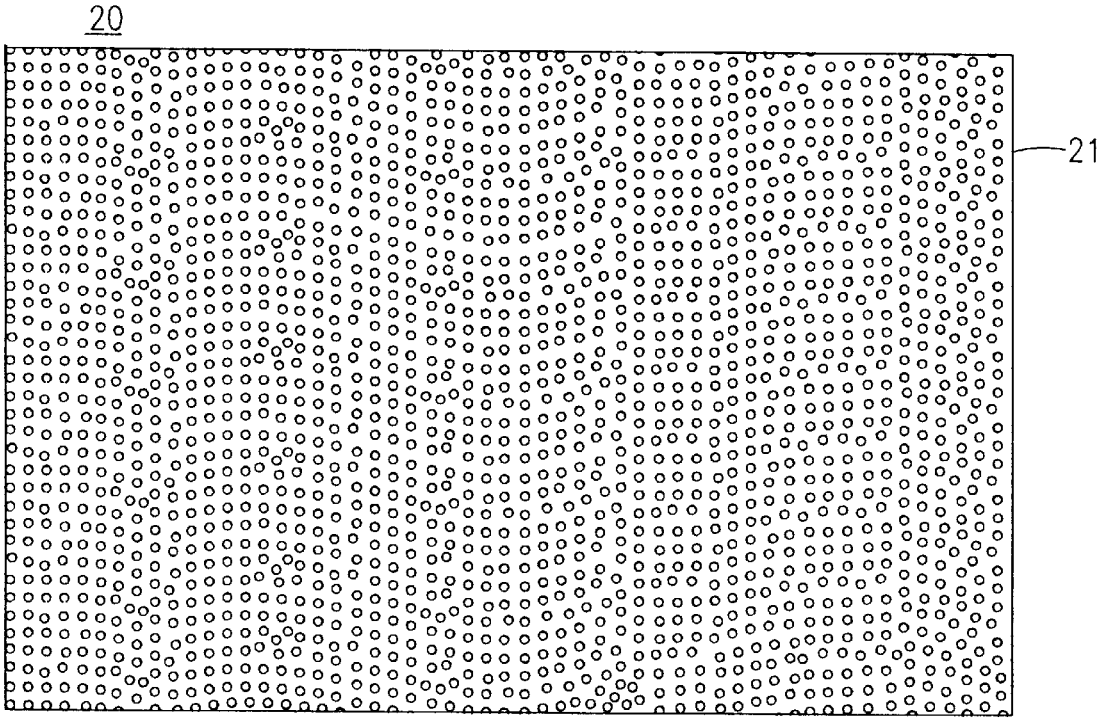
FIG. 2 is a photographic representation of part of a typical drum according to the invention, in which the micro-holes are arranged in a random manner.

The device also includes a perforated, rotating cylindrical drum 20 placed immediately adjacent to, and in contact with, the belt 1 at its descending portion and placed between the feed roller 2 and the guide roller 3. The perforated rotating drum 20 is rotated by an asynchronic motor (not shown) at the same peripheral linear speed as that of the belt 1. The rotating drum may be made of nickel, is 0.4 mm thick and 500 mm in diameter, and has a large number of micro-holes 21 distributed on its surface in a random manner, the distribution of said micro-holes being achieved by means of serigraphy and electrolytic deposit, as describes above and depicted in FIG. 2.

Each micro-hole 21 has an average diameter of 0.40 mm and a slightly truncated cut; the distance between holes (edge to edge) is 0.8 mm. The porosity of the drum 20 is thus approximately 10%.

As seen in FIG. 1, the perforated rotating drum 20 is in contact with belt 1 along portion of an arc of the circle. In other words, there is close contact between the perforated rotating drum 20 and the micro-holes 21 on a portion of an arc defined by references A, for example, a portion of 10°–20°. This close contact ensures progressive compression of the cloth 10.

The perforated rotating cylindrical drum 20 has a diameter of 500 mm, and contains inside it a second, coaxial, fixed hollow cylindrical drum 25 connected to a vacuum source (not shown) in such a manner as to form a suction box. The depression inside the drum 25 is an approximately 500 mm water column.

The device also includes a first row of water jets 30, placed to the left of the belt 1 relative to zone A in such a manner as to form a water curtain 31 directed at a right angle to A. The water leaves the row of water jets 30 under a pressure of 5 bars.

The fixed hollow drum 25 forms a suction box and includes, aligned with the water curtain 31, a slot 32 having a width of 20 mm and placed across the entire hollow drum 25 in such a manner as to draw the excess water from the water curtain 31. Thus, the cloth 10, moving along the porous conveyer belt 1, is gradually compressed by being pinched between conveyor belt 1 and rotating perforated cylindrical drum 20, both of which progress at the same linear speed. The cloth is then moistened by the water curtain 31, with the remaining excess of water, not retained by the compressed base cloth, being drawn up by the hollow drum 25. The moist compressed cloth 40 thus obtained is held on the surface of perforated, rotating cylindrical drum 20 due to the pressure applied by drum 25.

The cloth 40 moves in the direction of arrow F2, and is subsequently subjected to the action of three rows of injectors 41, 42, 43 respectively, which direct a large number of contiguous water jets, at a pressure of 40 bars, towards the cloth 40. The central drum 25 is provided with slots 45, 46, 47 analogous to slot 32, a slot being placed opposite each of the rows of high-pressure water jets in order to draw in and remove the interweaving water.

According to the invention, the high-pressure water jets interact with the micro-holes 21 distributed randomly on the surface of the rotating drum 20, thus causing the intermingling and tangling of the elementary cloth fibers.

The intermingled spunlace cloth thus obtained at 50 passes over a rerouting roller 51 and is thus detached from the rotating drum 20; it is then led towards the exit of the device 52

Reference 60 (FIG. 3) depicts the final unpatterned cloth obtained by the process of the invention.

EXAMPLE 1

The base cloth 10 is a 50 gsm cloth from viscose fibers 38 mm long and having a grade of 1.7 dtex. The compacted, pre-moistened cloth moves at a speed of 50 meters per minute. The surface of the perforated rotating drum 20, illustrated in FIG. 2, has an average of approximately 80 holes per $cm^2$, distributed according to the invention in a totally random manner (porosity is in the region of 10%).

Figure 3:
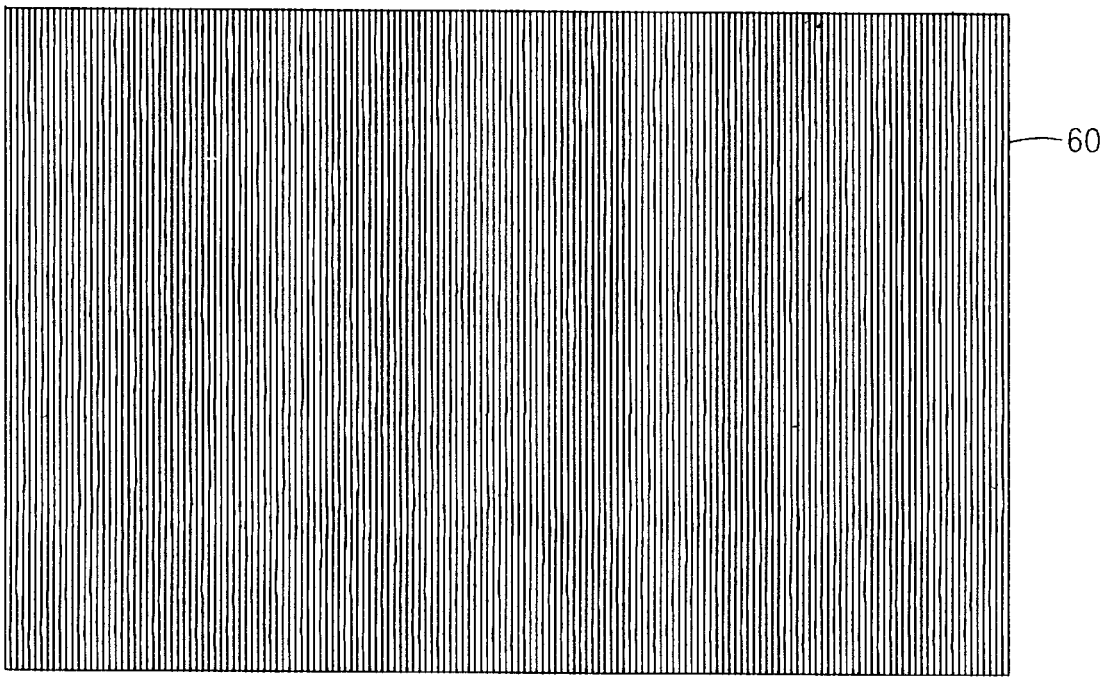
FIG. 3 is a photographic plan representation of a non-woven cloth produced according to the process of the present invention.

The cloth 50 obtained, illustrated in FIG. 3, shows the following properties, measured in conformity with the standard EDANA 20.2.89.

Length (L): 53 Newtons/50 mm

Breadth (B): 46 Newtons/50 mm

EXAMPLE 2

Figure 4:
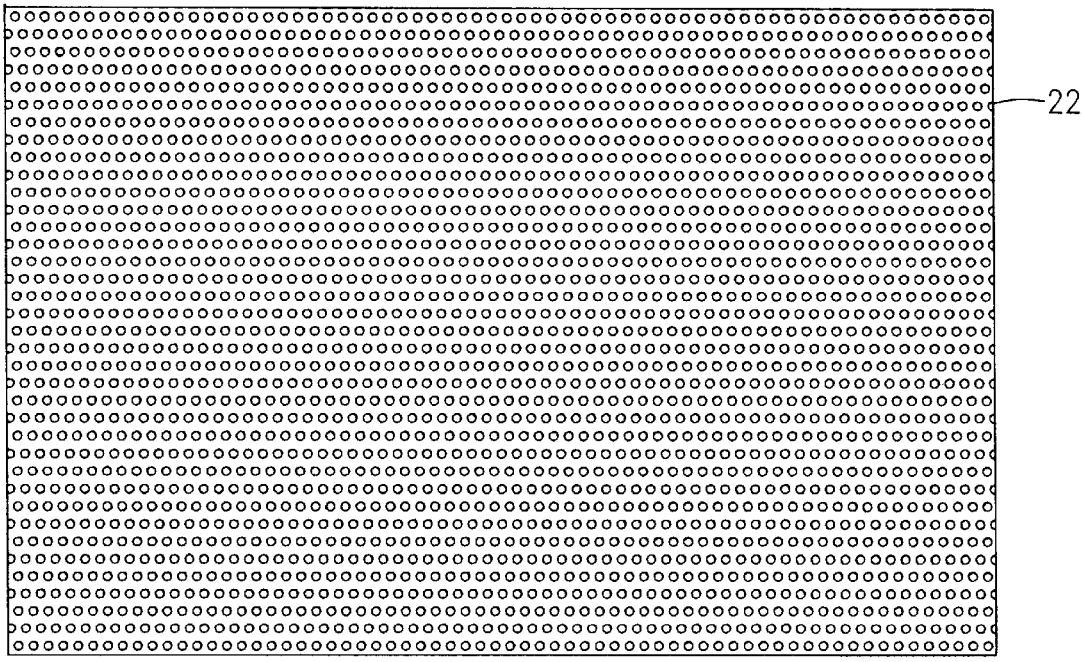
FIG. 4 is a photographic representation, on the same scale as FIG. 2, of part of a drum in which the micro-holes are placed in a computerized and staggered manner, for usage according to the invention.
Figure 5:
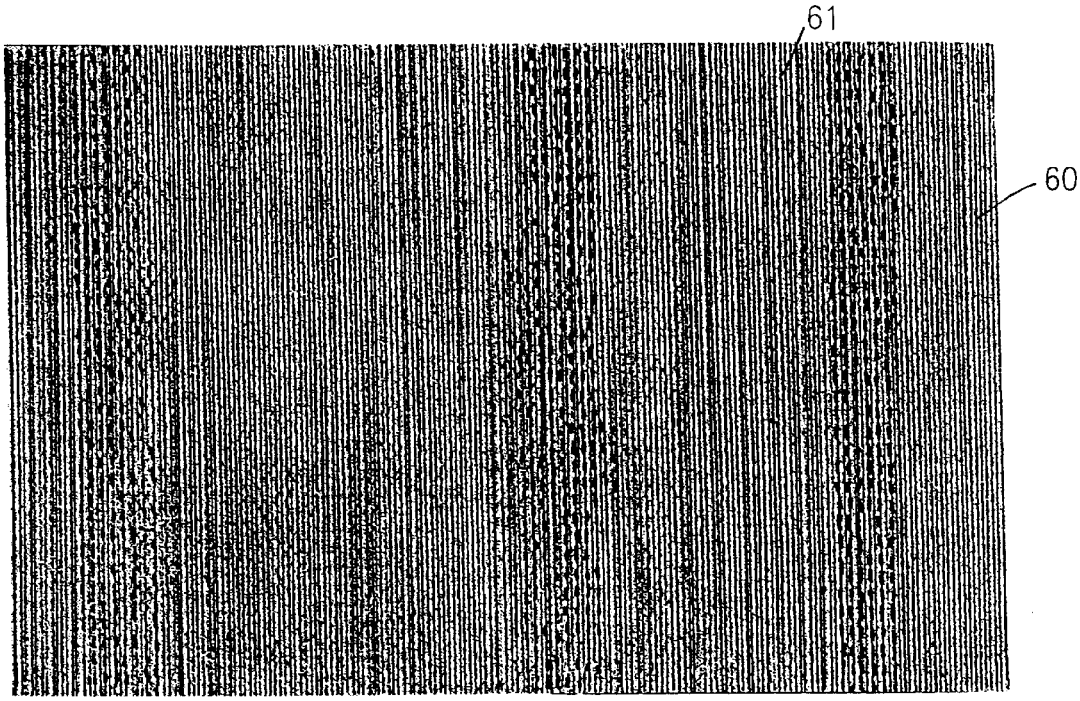
FIG. 5 is a photographic plan representation of part of the non-woven cloth produced by utilization of the drum according to FIG. 4.

Example 1 was repeated, but the randomly-perforated rotating drum was replaced with a rotating drum of the traditional kind, including micro-holes 22 (FIG. 4) of the same dimension (0.4 mm), but distributed in a regular zigzag fashion as illustrated, with a density of micro-holes of eighty (80) holes per $cm^2$. The cloth 60 obtained is shown in FIG. 5, and exhibits the following mechanical properties:

L: 29 N/50 mm.

B: 27 N/50 mm.

This cloth also shows cardinal defects and a pronounced shadow marking effect 61, making it unsuitable for any use.

EXAMPLE 3

Example 1 (using a randomly-perforated rotating drum) was repeated, but the viscose cloth was replaced with a 40 gsm polyester fiber cloth manufactured from basic fibers of a length of 38 mm and 1.7 dtex in grade.

The cloth obtained at 50 (FIG. 1) shows the following properties:

L: 4 N/50 mm.

B: 21 N/50 mm.

This cloth does not show any shadow marking effect, and is thus quite suitable for current usage.

EXAMPLE 4

Example 2 (regular distribution) was repeated with the same polyester cloth used in Example 3. The following properties were obtained:

L: 25 N/50 mm.

B: 10 N/50 mm.

The cloth obtained is only marginally acceptable, with significant shadow marking effects.

EXAMPLE 5

Example 3 (random distribution) was repeated, but the pressure of the injectors was increased to 70 bars. The cloth obtained still showed no shadow marking effect; on the contrary, the surface is highly regular. This cloth has the following mechanical properties:

L: 59 N/50 mm.

B: 27 N/50 mm.

The process of the invention, which consists of distributing the micro-holes on the surface of the rotating drum in a random manner, leads to an unexpectedly dramatic suppression of the fault of shadow marking; thus, the water jet pressure can be increased, with a consequent improvement in the efficiency of the interweaving. Moreover, the process of the present invention improves the mechanical properties of the obtained cloth by thirty percent (30%) and more. It could not have been predicted that such a simple arrangement would lead to a dramatic improvement in both the mechanical properties of the product and in the suppression of the fault of shadow marking, with a hereinbefore unparalleled level of bonding effectiveness. In brief, this random arrangement makes the unexpected difference between failure and success.

What is claimed is:

1. A device for the manufacture of non-woven, unpatterned cloth using pressurized water jets, the device comprising:

conveying means for supporting and conveying a continuous fibrous base cloth produced from elementary fibers;

a rotating cylindrical, perforated drum having a surface provided with a plurality of micro-holes and positioned adjacent said conveying means;

vacuum take-up means for allowing said drum to take-up said base cloth from said conveying means; and a plurality of water jets for directing a pressurized stream of water onto said base cloth on said drum, wherein said micro-holes of said rotating drum are distributed on the surface of the drum in a random manner, wherein said conveying means includes a porous, continuous belt adapted to receive said fibrous base cloth and means for driving said belt, said device further comprising means for rotating said drum, wherein said rotating means is synchronized with the speed of movement of said porous conveyor belt, said belt being arranged tangentially to said rotating drum.

2. A device as recited in claim 1, wherein said vacuum means includes a hollow, cylindrical drum disposed within said rotating drum and a vacuum source linked to said hollow drum, said hollow drum having a first slot configured adjacent intersecting position of said rotating drum and said porous conveyor belt.

3. A device as recited in claim 2, wherein said plurality of water jets includes a first row of water jets disposed on the opposite side of said porous conveyor belt relative to said rotating drum, said first row of jets being aligned with said first slot so as to form a water curtain.

4. A device as recited in claim 3 including at least one second row of water jets adjacent said rotating drum and oppositely disposed relative to at least one second slot in said hollow drum.

5. A device as recited in claim 1, including means for receiving a processed cloth from said drum.

6. A device as recited in claim 1, wherein adjacent micro-holes are spaced on said drum surface in the range of approximately 0.3 mm to 2 mm.

7. A device as recited in claim 1, wherein the diameters of said micro-holes are sized in the range of approximately 0.1 mm to 0.5 mm.

8. A device as recited in claim 7, wherein the dimensions of the micro-holes are randomly distributed over the surface of said rotating drum.

9. A device for the manufacture of non-woven, unpatterned textile cloth using pressure water jets, including:

a porous, continuous conveyor belt adapted to receive a fibrous base cloth produced from elementary fibers;

movement means for driving said porous belt;

a rotating, cylindrical, perforated drum, the surface of said drum being provided with a plurality of micro-holes;

movement means synchronized with the speed of movement of said porous conveyor belt, said belt being arranged tangentially to said rotating drum;

a hollow, cylindrical drum affixed inside said rotating drum and linked to a vacuum source; said hollow drum being provided with a first slot configured to be placed adjacent to the meeting point of said rotating drum, and said porous conveyor belt;

a first row of water jets placed on the other side of the porous conveyor belt relative to said rotating drum, and in alignment with said first slot in such a manner as to form a moisturizing water curtain;

at least one second row of water jets placed adjacent to said rotating drum opposite at least one second slot located in said hollow drum; and means for receiving the moist compressed cloth thus produced;

wherein the micro-holes of said rotating drum are distributed on the surface of the drum in a random manner.

10. The device according to claim 9, wherein adjacent micro-holes are spaced on said drum surface, said spacing between adjacent micro-holes being in the range of approximately 0.3 mm to 2 mm.

11. The device according to claim 9, wherein the diameter of said micro-holes are sized in the range of approximately 0.1 mm to 0.5 mm.

12. The device according to claim 11, wherein the dimensions of the micro-holes are randomly distributed over the surface of the rotating drum.

* * * * *